US009170515B2

(12) United States Patent
Deprez et al.

(10) Patent No.: US 9,170,515 B2
(45) Date of Patent: Oct. 27, 2015

(54) LIQUID DEVELOPER DISPERSION FOR DIGITAL PRINTING PROCESS

(71) Applicant: Xeikon IP BV, Eede (NL)

(72) Inventors: Lode Erik Dries Deprez, Wachtebeke (BE); Werner Jozef Johan Op de Beeck, Putte (BE); Mathias Jo Bert van Remortel, Wechelderzande (BE); Dirk Marcel Constant Gijsbrechts, Melsele (BE)

(73) Assignee: Xeikon IP BV, Eede (NL)

( * ) Notice: Subject to any disclaimer, the term of this patent is extended or adjusted under 35 U.S.C. 154(b) by 11 days.

(21) Appl. No.: 14/038,876

(22) Filed: Sep. 27, 2013

(65) Prior Publication Data

US 2014/0093822 A1 Apr. 3, 2014

(30) Foreign Application Priority Data

Sep. 28, 2012 (EP) ..... 12186676

(51) Int. Cl.

| | |
|---|---|
| ***G03G 9/00*** | (2006.01) |
| ***G03G 9/125*** | (2006.01) |
| ***G03G 9/13*** | (2006.01) |
| ***G03G 9/135*** | (2006.01) |
| ***G03G 9/08*** | (2006.01) |
| ***G03G 13/11*** | (2006.01) |

(52) U.S. Cl.

CPC ..... *G03G 9/125* (2013.01); *G03G 9/0806* (2013.01); *G03G 9/13* (2013.01); *G03G 9/133* (2013.01); *G03G 9/135* (2013.01); *G03G 13/11* (2013.01)

(58) Field of Classification Search

CPC ..... G03G 9/135
USPC ..... 430/115, 137.22
See application file for complete search history.

(56) References Cited

U.S. PATENT DOCUMENTS

| | | | | |
|---|---|---|---|---|
| 4,476,210 | A * | 10/1984 | Croucher et al. | 430/114 |
| 5,545,504 | A * | 8/1996 | Keoshkerian et al. | 430/137.17 |
| 7,995,953 | B2 | 8/2011 | Ozerov | |
| 2009/0023088 | A1 | 1/2009 | Teshima et al. | |

FOREIGN PATENT DOCUMENTS

| | | | |
|---|---|---|---|
| EP | 0747786 | A2 | 12/1996 |
| EP | 1120647 | A2 | 8/2001 |

* cited by examiner

*Primary Examiner* — Mark A Chapman
(74) *Attorney, Agent, or Firm* — The Webb Law Firm

(57) ABSTRACT

This invention is related to a liquid developer dispersion for use in a digital printing apparatus comprising a non volatile carrier liquid, a marking particle and a dispersing compounds, wherein the marking particle in the liquid developer dispersion is stabilized during storage and wherein at fusing two phases are formed. The invention is also related to the use of the developer in a digital printing apparatus and to a method for preparing the liquid developer dispersion.

19 Claims, 2 Drawing Sheets

Coalescence NOK

Coalescence OK – Conductivity NOK

Coalescence OK – Conductivity OK (a) (b) (c)

LIQUID DEVELOPER DISPERSION FOR DIGITAL PRINTING PROCESS

This application claims priority to European Patent Application No. 12 186 676.8, filed Sep. 28, 2012, the disclosure of which is hereby incorporated by reference in its entirety.

BACKGROUND OF THE INVENTION

1. Field of the Invention

This invention is related to a liquid developer dispersion, a method for preparing the liquid developer dispersion, a printing process using the liquid developer dispersion and an image forming apparatus using the liquid developer dispersion.

2. Description of Related Art

Liquid developer dispersions are known in the art and are used for electrophotography and developing electrostatic latent images formed on a latent image carrying member in a digital printing process using a digital printing apparatus. An example of such printing apparatus is provided in the U.S. Pat. No. 7,995,953 the content of which is incorporated into this application in its entirety by this reference. Liquid developer dispersions, also called liquid toners are usually made of a carrier liquid and a marking particle. The carrier liquid is a non-aqueous solvent carrier.

A problem of known liquid developer dispersions, is that the carrier liquid in the liquid developer dispersion is often volatile so that during transfusing or fixation of the marking particle on a transfer medium such as paper, the carrier liquid vaporizes in the atmosphere, which is harmful for the environment if the condensation of the carrier liquid is not fully controlled.

Another problem of liquid developer dispersions which are currently used is that the carrier liquid stays present after fusing in the final substrate. The remaining carrier liquid on the paper substrate accumulates during paper recycling, which causes disadvantages in paper recycling processes. In addition, the remaining carrier liquid can migrate to foodstuffs, when the paper is used for food packaging.

SUMMARY OF THE INVENTION

It is an object of the invention, amongst other objects, to provide a developer dispersion which is friendlier for the environment.

It is another object of the invention to provide a liquid developer dispersion comprising a carrier liquid, which can be reused, preferably without any difficult additional treatment, where the reused carrier liquid has the same or similar properties such as conductivity as for the carrier liquid in liquid developer dispersion before printing.

Yet, it is another object of the invention to provide a liquid developer dispersion, which leaves a minimum or no amount of carrier liquid on the final substrate.

Further, it is another object of the invention to provide a liquid developer dispersion that can be used on non absorbing substrates (such as labels and packaging materials), and comprises a carrier liquid that can be removed after fusing has taken place.

It is another object of the invention to provide a toner dispersion that is economically interesting and cost friendly.

Yet, another object of the invention is to provide a liquid developer dispersion which has good charging and fusing properties.

Yet, another object of the invention to provide carrier liquid dispersion that fuses fast on different substrates to deal with the new speeds that are needed in digital printing (>50 cm/s).

The above objects, amongst other objects, are met at least partially, if not completely, by a liquid developer dispersion as defined in claim 1.

Especially, the above described objects, amongst other objects are met at least partially, if not completely, by a liquid developer dispersion for use in a digital printing apparatus comprising a non volatile carrier liquid, a marking particle and a dispersing compound or a combination of dispersing compounds, wherein the marking particle in the liquid developer dispersion is stabilized during storage and during printing before fusing and wherein at fusing temperature a marking particle phase and a carrier liquid phase are formed.

DESCRIPTION OF THE INVENTION

The inventors surprisingly found that a liquid developer dispersion according to the invention has a shelf life stability that is guaranteed whereby the marking particle is dispersed in the carrier liquid. Also during printing the marking particle is stable and evenly dispersed in the developer dispersion. In addition, at the moment of fusing, the liquid developer is instable, collapses and forms very fast two phases, in particular the marking particle phase and the carrier liquid phase.

The liquid developer dispersion, according to this invention, is used for digital printing using a digital printing apparatus. The liquid developer dispersion, also called developer dispersion or liquid toner, comprises marking particles, a carrier liquid and a dispersing compound or compounds. It may also comprise further compounds such as compounds for arranging the viscosity or charge control agent (CCA), wax, plasticizers, and other additives.

The marking particles, according to this invention, comprise colored particles (also called ink particles or pigment) and a binder resin, which is a polymer, preferably transparent, that embeds the ink particles and other optional compounds like wax, plasticizer or other additives. The marking particles are extrudates of the binder resin and the colored particles. The marking particles are made by extrusion of binder resin and colored particles. The marking particles are particles with a diameter of typically about 0.5 to 4.0 μm. The marking particles have a concentration of about 40-95% of the binder resin. Preferably a polyester resin is used as binder resin. The resin has preferably a high transparency, provides good color developing properties and has a high fixing property on the substrate. The marking particles are chargeable imaging particles or have chargeable locations. The material properties of the marking particle make them prone to developing static electric charges, which allow them to be transported between different components and subprocesses of the printing system by the application of a suitable electric field. This process is further described in the patent application with application number EP12175762, the content of which is incorporated into this application in its entirety by this reference. The compatibility of the marking particle according to this invention, with the carrier liquid is low. The marking particle should upon heating towards the fusing temperature create a macroscopic different phase with the carrier liquid in such way that the two phases (marking/liquid) can be separated from each other. On the other hand, it is important that the marking particles are and stay homogeneously dispersed in the carrier liquid during the storage and first steps of the printing process A carrier liquid in a liquid developer dispersion can be volatile or non volatile and "carries" the marking particles finally to the substrate to be printed. To obtain a print with a good printing and finishing quality, it is important that most of the carrier liquid is removed during fusing and a minimum of the carrier liquid is left on the printing substrate. This can be performed using a volatile carrier that evaporates at fusing temperature. However, to overcome some of the environmental drawbacks described above, the invention uses a liquid developer wherein the carrier liquid is non volatile. This means that the carrier liquid has a boiling point which is high enough so that at fusing temperature, the carrier liquid remains liquid and does not evaporate. In one embodiment of the invention, the non volatile carrier liquid has a boiling point of at least 200° C. at atmospheric pressure.

The carrier liquid according to the invention has further a very low conductivity. This allows the dispersed and charged marking particles to be susceptible to acceleration under the effect of an electric field (electrophoresis), and that the marking particles are capable of retaining an electrical charge for some time This charge may be attained by the particles as a result of charge exchange between the particles and salts on the surface of the marking particle, or it may be induced by an externally applied electric field. The carrier liquid can be any suitable liquid as is known in the art, and may be silicone fluids, hydrocarbon liquids and vegetable oils, or any combinations thereof.

The dispersing compound, according to this invention, is able to make a dispersion of marking particles in the carrier liquid.

According to this invention, with "fusing" is meant the event upon which the liquid developer dispersion is separated in a liquid developer phase and a marking particle phase, the marking particle phase is adhered on a substrate to be printed. With "fusing temperature" is understood the temperature at which fusing occurs.

The liquid developer dispersion according to the invention comprises marking particles, a carrier liquid and dispersing compound wherein the marking particles do not clump or settle in the carrier liquid during storage and during the printing process before fusing, and whereby the developer dispersion does not collapse under the influence of the mechanical pressure applied to the liquid developer dispersion for example under the form of scraper blades or via pumping activity. It is important that the concentration of the free, non absorbed dispersing compound is as stable as possible throughout the printing and fusing process. If this is not the case this may result in change in charging behavior of the marking particles, image quality problems, a non stable transfer efficiency of the marking particles and possible fusing problems. The marking particles, the carrier liquid and dispersing compound are composed in such a way that the liquid developer dispersion collapses at the moment of fusing and two phases are formed, the marking particle phase and the carrier liquid phase. In other words at the moment of collapsing the individual marking particles come together and form a continuous resin film that adheres to the substrate surface and of which the carrier liquid phase is separated. The liquid developer dispersion is composed in such a way that the stable dispersion does not transform into a stable emulsion at fusing since this would result in an image with bad adhesion properties of the marking particles on the substrate, resulting in a bad printing quality and/or handling performance of the printed image. The concentration of the dispersing agent in the liquid can be identified by analytic means (e.g. HPLC, or by measuring the conductivity of the liquid system.

According to this invention, the dispersing compound is a molecule that is capable of stabilizing the surface of the marking particles in the carrier liquid during storage and during printing before fusing and has preferably a HLB (Hydrophilic-lipophilic balance) value between 1-5.

The dispersing agent has a good marking particle surface absorbance at room temperature and a different behavior towards the marking particle phase at the moment the temperature of Tg+20° C. is approached or superseded, wherein the Tg is between 40 and 70° C. The behavior change can be an increase in solubility or a total collapse of the dispersing capabilities resulting in a non stable dispersion or emulsion at that time and temperature. It is important that most, or preferably all, the dispersing agent comes in or into the marker particle phase at the moment of fusing and only a low amount of the dispersing compound enters the carrier liquid phase. The formed carrier liquid phase is as good as clear and substantially comprises the carrier liquid. This is important so that the composition of the non volatile carrier liquid phase doesn't change too much compared with the composition of the carrier liquid. In most of the cases this can be evaluated by measuring the conductivity of the carrier liquid phase and the carrier liquid which shows in most of the cases a good correlation between concentration of dispersing agent and conductivity.

There is thus a subtle balance between absorbance and solubility of the dispersing compound with the marker particle, which is influenced by the marking particle behavior (monomer composition, glass transition temperature, presence of plasticizer and pigments) and the type of carrier liquid used for preparing the liquid developer dispersion. The balance can also be influenced by the way the marking particles are prepared (e.g. bead milling, ball jar milling) or by making a dispersion using the extrudate and a dispersing agent at elevated temperature in an apolar liquid whereby the system passes through an emulsion phase prior to cooling down to room temperature). The dispersing compound according to the invention, can potentially be screened by mixing the dispersing compound with the complete marking particles or the resin compound, which is used for preparing the marking particle, and carrier liquid only and keeping the mixture at a temperature around Tg (e.g. Tg−10° C. to Tg+20° C.) while following the conductivity of the mixture. If the tendency is observed that the conductivity lowers over a certain period of time, it gives a possible indication that a certain blending of the dispersing agent in the specific marking particle/resin can be established at fusing temperature. When this is observed, the tested dispersing agent are then be evaluated with respect to the milling, stability, fusing and printing behavior to see if a developer dispersion according to the invention is obtained.

In one embodiment according to this invention, the liquid developer dispersion forms a clearly distinguishing marking particle phase and a carrier liquid phase in less than 60 seconds, preferably less than 40 seconds, more preferably less than 15 seconds, when the developer dispersion has a concentration of at least 30% marking particles, and a droplet of the liquid developer dispersion is put on a hotplate, having a material of e.g. Teflon or capton (polyimide foil), at 150° C. The formed carrier liquid phase is as good as clear and substantially comprises the carrier liquid.

The inventors surprisingly found that a liquid developer dispersion comprising the above properties, are developer dispersions according to the invention, of which the carrier liquid phase and the marking particle phase collapse during fusing. The inventors also found that liquid developer dispersions having the above properties collapse sufficiently fast at the moment of fusing, so that the developer dispersion can be used in high speed digital printing apparatus. The inventors found a relative easy way to find a developer dispersion that is suitable for high speed digital printing apparatus by performing a test where the liquid developer dispersion (e.g. one drop) having a concentration of at least 20% marking particles, and being put on a hotplate at 150° C. of e.g. polytetrafluoroethylene (Teflon®) plate or polyimidefoil (capton®), the collapsing into the marking particle phase and the carrier liquid phase occurs in less than 60 seconds. In one embodiment of the invention the liquid developer dispersion has the properties so that it fulfills the requirements of this test.

In another embodiment of the invention, the liquid developer dispersion forms a carrier liquid phase after being put on a hotplate of which the conductivity B of the this carrier liquid phase (measured at room temperature), is less than 5 times the conductivity A+5 (expressed in picosiemens per cm) preferably less than 3 times the conductivity A+5, more preferably less than 2 times the conductivity A+5 or most preferred has the same conductivity as conductivity A, wherein conductivity A is the conductivity of the carrier liquid obtainable by centrifuging at 18000 RCF (relative centrifugal force) for 45 minutes of the liquid developer dispersion and separating the carrier liquid from the marking particles. The carrier liquid phase formed on the hot plate comprises almost no content of dispersing compounds so that the composition of the carrier liquid phase doesn't change too much compared with the composition of the carrier liquid, (and thus the conductivity of the carrier liquid phase stays in the same range. Most of the dispersing compounds are blended or precipitated in/onto the marking particle and form part of the formed marking particle phase.

It is important for the invention that the carrier liquid phase can be collected mechanically after printing and can be reused for diluting fresh concentrated liquid developer dispersion comprising for example 35 to 45% marking particles to liquid developer dispersion with the right workable strength of 10 to 30% marking particles. To be able to reuse the carrier liquid phase, it is important that almost no, or preferably no additional free dispersant or other components enter the carrier liquid phase at the moment of fusing. This means that when the developer collapses, most of the dispersant has to stay on or in the marking particle phase. If too much dispersant would enter the carrier liquid phase, it would not be possible to reuse the carrier liquid phase for preparing fresh liquid developer as such, since the composition of the carrier liquid phase would not be the same as the composition of the carrier liquid and the conductivity would be too high, resulting in a poor printing quality, as described above. The inventors found that the concentration and the type of dispersing compound and carrier liquid must be chosen so that the conductivity B of the carrier liquid phase, formed after that the liquid developer was put on the hotplate, is less than 5 times conductivity A+5 pS/cm, preferably less than 3 times conductivity A+5 pS/cm, more preferably less than 2 times conductivity A+5 pS/cm, most preferred has the same conductivity A of the carrier liquid obtainable by centrifuging the developer dispersion and separating of the carrier liquid. Liquid developers having these properties form, at the moment of fusing in a digital printing apparatus, a carrier liquid phase that has the right composition or conductivity, so that the carrier liquid phase, after it is removed, can be reused for preparing fresh liquid developer according to the invention.

In addition to the collapsing and stabilization properties of the liquid developer dispersion as described above, it is also important, that there is coalescence of the liquid developer dispersion at the moment of fusing. Accordingly, in another embodiment of the invention, the liquid developer dispersion shows at fusing temperature coalescence of the marking particles at a speed that is sufficiently fast for high speed digital printing equipment. According to this invention, with coalescence is understood that the marking particles melt and form a film or a continuous phase that adheres well to the substrate and that is separated from the carrier liquid phase. The coalescence is crucial at the moment of fusing and must occur sufficiently fast, and at a speed that is required to be able to print at 50 cm/second or more.

In one embodiment of the invention, the dispersing compound or the combination of the dispersing compound remains, precipitates, or embeds in the melted marking particles phase on the substrate during fusing. The dispersing compound or the combination of the dispersing compounds is able to dissolve at fusing temperature in the formed marking particles phase.

The fusing temperature of a digital printing apparatus and according to this invention is typically between 80° C. and 170° C.

As described, the collected carrier liquid phase after fusing can be reused again for preparing fresh liquid developer dispersion, which is suitable for electrophotographic printing. For the latter purpose, the collected carrier liquid phase can be either used as such, or with a minimal treatment, such as a filtration step, whereby small non dissolved contaminants can be removed.

In one embodiment of the invention, the carrier liquid has an electric conductivity at room temperature of at most 300 pS/cm, preferably at most 30 pS/cm and more preferably at most 3 pS/cm In another embodiment, the dielectric constant of the carrier liquid is less than 3.5.

In another embodiment, the carrier liquid is selected from the group consisting of a mineral oil, a low or high viscosity liquid paraffin, isoparaffinc hydrocarbons a fatty acid glyceride, a fatty acid ester or a vegetable oil or a combination thereof. Typical commercially available carrier liquids are Isopar M and Isopar V and higher boiling point Isopars from Exxon, white mineral oils from Sonneborn Inc, Parrafin Oils or Petro Canada and vegetable oils from Cargill The liquid developer dispersion according to this invention has at working strength, (e.g. 15% to 30% solid content concentration), a viscosity behavior that is preferably Newtonian or slightly non Newtonian. High viscosities (above 4000 mPas) at low shear (less than 10 Hz) should be avoided since this can give problems in transporting the ink inside the engine in a reliable way.

According to this invention, "solid content" means the amount of marking particles in wt % with regard to the total liquid developer dispersion.

The viscosity of the carrier liquid is also an important factor in the absolute value of the final viscosity of the liquid developer dispersion. In one embodiment, the liquid developer dispersion (at about 20% solid content concentration) has a low shear (1 Hz) viscosity of between 15 and 3000 mPas since this provides the best rheological performance. In order to obtain this final rheological behavior, the carrier liquid therefore has a viscosity from 1 to 1000 mPas, preferably form 3 to 500 mPas, more preferably from 3 to 100 mPas measured at 25° C. at a shear rate of 1 Hz.

In one embodiment, the marking particles have a content in the liquid developer dispersion from 10 to 60 wt %, preferably from 15 to 45 wt %.

In another aspect, the invention is related to a process for printing using the liquid developer dispersion according to the invention, wherein the process comprises the steps of fusing whereby the liquid developer dispersion collapses and separates in the marking particle phase and the carrier liquid phase and the marking particle phase adheres onto the substrate, removing of the carrier liquid phase, whereby the removing occurs via a non evaporating step.

During the first step the liquid developer dispersion collapses and a separation between the marking particle phase and the carrier liquid phase occurs. During this step also the main part of the adhesion of the marking particle onto the substrate is realized.

In one embodiment the fusing occurs by using without limitation, a non contact fusing concept based on infrared heating, ultrasonic fusing, microwave fusing, hot air fusing or steam fusing. According to this invention, non-contact fusing concept means that there is no contact between the printed substrate and the heating member. A contact fusing, for example a heated roller, can also be used. In that case the non printed side is heated. The temperature of the heating members is adjusted in such a way that a proper coalescence and adhesion is achieved.

During the second step the separated carrier liquid phase is removed through a non evaporation step. In one embodiment, the removal of the carrier liquid phase is performed by, without limitation, using rollers with scrapers on, blowing off the carrier liquid phase, by suction of the carrier liquid phase, by a cleaning web or by using foam. When rollers are used they can be heated or non heated. When heated rollers are used they can also function as gloss regulating means and/or fusing means to further improve the adhesion.

The invention is further related to a printing apparatus comprising a fusing station comprising two parts, wherein at the first part fusing occurs and the liquid developer dispersion collapses and separates into a marking particle phase and a carrier liquid phase and the marking particle phase adheres onto the substrate and at the second part the carrier liquid phase is removed via a non evaporating step.

In one embodiment the first part where fusing occurs comprises an apparatus suitable for, without limitation, non contact fusing comprising means for infrared heating, ultrasonic fusing, microwave fusing, hot air fusing or steam fusing. An apparatus suitable for contact fusing comprising, for example a heated roller, can also be used. In that case the non printed side is heated. Also in this aspect, the temperature of the heating members is adjusted in such a way that a proper coalescence and adhesion is achieved.

In another embodiment, the second part comprises means for removing the separated carrier liquid phase through a non evaporation step. The means for removing the separated carrier liquid phase may comprise without limitation, rollers with scrapers on, means for blowing off the carrier liquid phase, means for suction of the carrier liquid phase, means for a cleaning web or means for applying foam. When rollers are used they can be heated or non heated. When heated rollers are used they can also function as gloss regulating means and/or fusing means to further improve the adhesion.

After printing, it is possible that a very small amount of residual carrier liquid phase remains on the substrate.

If this would be critical for post finishing operations (like for example lamination), the image on the substrate can be cured by for example UV or EB curing and modifying the unsaturated moieties (e.g. polybutadiene or vegetable oils with a degree of unsaturation), in the case these moieties are present in the carrier liquid phase.

In an aspect, the invention is further related to a process for preparing a liquid developer dispersion according to the invention comprising mixing the marking particles with the dispersing compound and the carrier liquid and forming a predispersion of the liquid developer dispersion, and further milling the predispersion to provide the liquid developer dispersion according to the invention. The marking particles can be first prepared by mixing the compounds (e.g. resins, pigments and other optional additives) of the marking particles. The marking particles are then blended and extruded or kneaded at elevated temperature in order to obtain a uniform dispersion of the different compounds into the resin. Afterwards this extruded material is milled down by appropriate milling devices such as a hammermill or jetmill to a particle size of 7 to 500 μm. These particles are subsequently mixed together with the dispersing agent(s) and the carrier liquid(s) and stirred so that a predispersion of the liquid developer dispersion is formed. This predispersion is then brought into a liquid milling device such as a bead mill, triple roll, microfluidizer or ball mill or other suitable milling technique. During this operation the marking particles are milled down to the desired particle size of 0.5 to 4 μm in order to obtain the liquid developer dispersion according this invention.

A (partial) alternative to the milling of the predispersion in the milling device can be a step whereby the extrudate has been brought into a carrier liquid above the Tg whereby high shear mixing is applied in the presence of a suitable dispersing agent whereby an emulsion is being formed. After cooling down below Tg small particles are present which can be finalized or further reduced in size.

After this milling step an optional finishing step can be performed whereby some parameters can be adjusted. Such step can be for example (without limitation) adding small amounts of additives to the liquid developer dispersion to adjust for example the conductivity or a heating step or high shear mixing step to adjust the rheology (viscosity) profile.

The technical effects and advantages of the various embodiments of the process for preparing a developer dispersion according to the present invention correspond mutatis mutandis to those described above in connection with developer dispersion according to the invention.

In another aspect of the invention, the developer dispersion according to the invention is used in a digital printing system, preferably in electrostatographic printing, or a tonejet type of equipment Also in this aspect, the technical effects and advantages of the various embodiments of the use of developer dispersion according to the present invention correspond mutatis mutandis to those described above in connection with developer dispersion according to the invention.

The liquid developer dispersion according to this invention comprises thus a carrier liquid and forms at fusing a carrier liquid phase, which can be collected and reused for preparing fresh liquid developer dispersion. The liquid developer dispersion has a very fast coalescence at fusing temperature, so that it can be used at high speed digital printing apparatus. In addition at storage temperature the developer dispersion is stable, and the dispersion is also mechanically stable during printing until fusing. The liquid developer dispersion further provides a good image quality and good transfer properties. The adhesion of the marking particle phase onto the substrate surface is also good. Further is the conductivity of the carrier liquid and the carrier liquid phase relatively low, and is the ratio between conductivity of the carrier liquid phase after hotplate/carrier liquid before hotplate+5 pS/cm (after centrifugation) of the developer dispersion less than 6, preferably less than 3.

This then generally describes the invention but to assist with understanding, reference will now be made to the figures and accompanying comparison and non-limiting examples which shows embodiments of the invention.

BRIEF DESCRIPTION OF THE DRAWINGS

FIG. 1 provides a representation of a liquid developer dispersion before and after fusing temperature, or being put on a hot plate. The dark balls represent marking particles, the grey area represents the carrier liquid and the dispersing compounds are represented by little circles with a coil.

FIG. 2*a* shows a picture of a hotplate with a drop of liquid developer dispersion where no separation in a timeframe of 60 seconds occurs. FIG. 2*b* shows a picture of a hotplate with a drop of liquid developer dispersion where the liquid developer dispersion shows some separation within 60 seconds. FIG. 2*c* shows a picture of a hot plate with a drop of liquid developer dispersion where a good separation of the liquid developer dispersion in a carrier liquid phase and a marking particle phase occurs within 60 seconds.

EXAMPLES

Figure 1A:
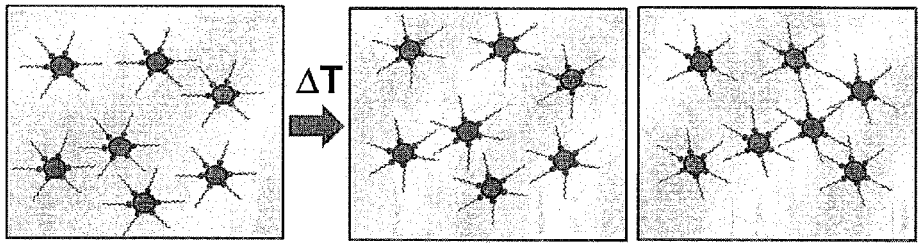
FIG. 1*a*) shows a liquid developer dispersion were no coalescence occurs at fusing temperature.
Figure 1B:
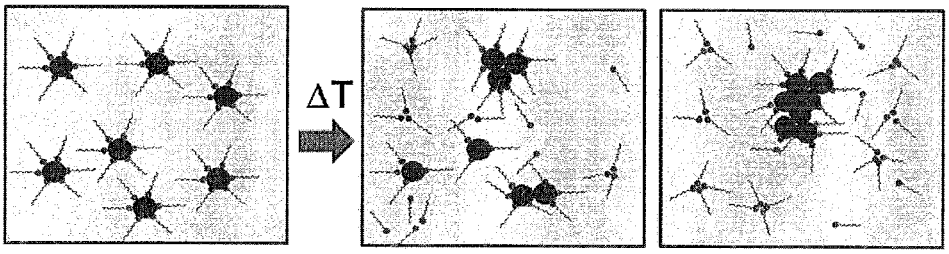
FIG. 1*b* ) represents a liquid developer where there is coalescence of the marking particles. The conductivity of the formed carrier liquid phase is not good since too much dispersing compound is residing in the carrier liquid phase.
Figure 1C:
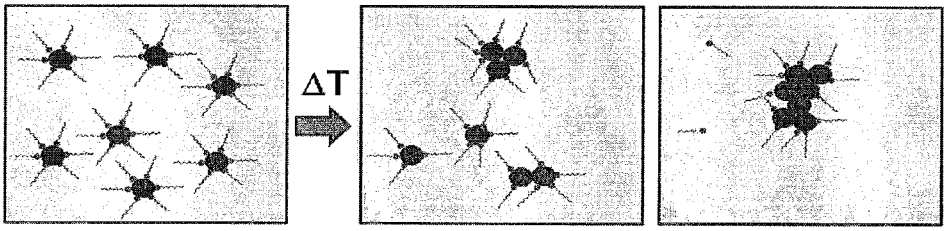
FIG. 1*c*) represents a liquid developer dispersion according to the invention. At fusing temperature, there is coalescence since there are two phases formed: a marking particles phase and a carrier liquid phase. In addition, the conductivity of the carrier liquid phase is good since almost no dispersing compound is found in the carrier liquid phase.
Figure 2:
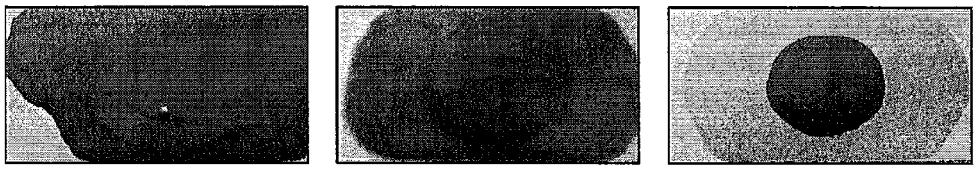
FIG. 2.

The present invention is described by example, where the following test methods are used to determine the following parameters.

Conductivity

The conductivity is measured with a device as described in EP1120647 with an electric field strength of $1.25\times10^6$ V/m.

Viscosity

The viscosity of the liquid developer dispersion and carrier liquid is measured with a Haake Rheostress RS600 operated in shear rate sweep from 0.1 to 30001/s at 25° C.

The instrument is equipped with a cone/plate geometry type C60/1° and the gap is set to 0.052 mm.

Particle Size Distribution

The particle size distribution is measured by a Mastersizer MS2000 from Malvern.

The milled down liquid developer dispersion is diluted before the measurement so as to obtain 10% obscuration during the measurement.

Dispersion Stability

The dispersion stability was measured by putting the dispersion at 35° C. for 48 hours. The particle size distribution was measured before and after the stability test. When no increase of dv50 is observed the dispersion stability is OK.

Adhesion Test

The adhesion is measured by a tape test.

A tape type Scotch Magic tape 19 mm of length 15cm is put on the fused image and removed slowly under an angle of 90 to 150° C. The tape is visually inspected and the adhesion is ranked as follows 1: no toner left on the tape: OK
2: almost no toner left on the tape: acceptable
3: small deposition of toner on the tape-still acceptable.
4: clear deposition of toner on the tape-unacceptable Hotplate One drop of the liquid developer dispersion is put on a hot plate of Capton® (polyimide tape of 3M) at 150° C. The coalescence is observed and the coalescence time is measured.

Afterwards the separated carrier liquid is collected.

Example 1

Several liquid developer dispersions are prepared and comprise a marking particle, a carrier liquid and a dispersing agent. The ingredients used to prepare the marking particles and the liquid developer dispersions are summarized in table 1.

TABLE 1 ingredients

| | name | description | Acid value (mg KOH/g) | Tg (° C.) (1) | Tm (° C.) (1) |
|---|---|---|---|---|---|
| polymers | PM1 | polyester resin | 12 | 60 | 99.8 |
| | PM2 | polyester resin | 7.6 | 48 | 86 |
| | PM3 | polyester resin with 40% biomonomer | 10 | 47.5 | 87 |
| additive | AD1 | toluenesulfonamide | | | |
| pigment | PIG1 | Heliogen Blau D7079 | | | |

| | name | description | base equivalent (2) |
|---|---|---|---|
| dispersing agents | DA1 | polymeric dispersing agents with a polyethylenimine backbone and polyhydroxystearate grafts | 560-620 |
| | DA2 | polymeric dispersing agents with a polyethylenimine backbone and polyhydroxystearate grafts | 1400-1700 |
| | DA3 | statistical copolymer of vinylpyrrolidone (20%) and long chain olefins (80%) | — |

TABLE 1-continued

| ingredients | | | | |
|---|---|---|---|---|
| | name | | viscosity 1 Hz @ 25° C. (mPas) | conductivity (pS/cm) |
| liquids | LIQ1 | mineral oil | 5 | 0.2 |
| | LIQ2 | mineral oil | 18 | 0.1 |
| | LIQ3 | vegetable oil (rapeseed) | 55 | 0.3 |

(1) measured according to ASTM D3418
(2) the amount of dispersing agent that is needed to neutralize 1 mol of acid The marking particles are prepared by kneading the ingredient as mentioned in table 2 at a temperature of 100 to 120° C. for 45 minutes. This mixture is cooled down and milled down to 10 μm by a fluidized bed mill.

TABLE 2

| composition of marking particles | | | | | | |
|---|---|---|---|---|---|---|
| | Polymer | | pigment | | additive | |
| name | name | conc (w/w %) | name | conc (w/w %) | name | conc (w/w %) |
| MAR1 | PM1 | 87.5 | PIG1 | 12.5 | | |
| MAR2 | PM2 | 87.5 | PIG1 | 12.5 | | |
| MAR3 | PM3 | 87.5 | PIG1 | 12.5 | | |
| MAR4 | PM1 | 81.5 | PIG1 | 12.5 | AD1 | 6 |

Afterwards the liquid developer dispersions are prepared as mentioned in table 3. A predispersion of the ingredients is made and stirred for 10 min at room temperature. The predispersion is than brought into the liquid milling device. The liquid developer dispersion is milled down to a dv50 of 1.8 to 2.5 μm except LD13 which was milled down to 3.8 μm using a bead mill (bead) or a ball jar mill (ball jar). The milling was done till the desired particle size, viscosity and conductivity was obtained.

TABLE 3

| liquid developer dispersion composition | | | | | | | |
|---|---|---|---|---|---|---|---|
| | marking particles | | dispersing agent | | carrier liquid | | |
| name | name | conc (w/w %) | | conc (w/w %) | | conc (w/w %) | mill-ing |
| LD1 | MAR1 | 35 | DA1 | 6.5 | LIQ2 | 58.5 | ball jarr |
| LD2 | MAR4 | 35 | DA1 | 4 | LIQ2 | 61 | bead |
| LD3 | MAR4 | 35 | DA1 | 4.2 | LIQ1 | 60.8 | ball jarr |
| LD4 | MAR4 | 35 | DA1 | 3.7 | LIQ1 | 61.2 | bead |
| LD5 | MAR4 | 35 | DA1 | 3.5 | LIQ3 | 61.5 | ball jarr |

TABLE 3-continued

| liquid developer dispersion composition | | | | | | | |
|---|---|---|---|---|---|---|---|
| | marking particles | | dispersing agent | | carrier liquid | | |
| name | name | conc (w/w %) | | conc (w/w %) | | conc (w/w %) | mill-ing |
| LD6 | MAR2 | 35 | DA1 | 3.8 | LIQ1 | 61.2 | ball jarr |
| LD7 | MAR3 | 35 | DA1 | 3 | LIQ1 | 62 | ball jarr |
| LD8 | MAR4 | 35 | DA1 | 4.5 | LIQ1 | 60.5 | bead |
| LD9 | MAR4 | 35 | DA1/ DA3 | 3/0.75 | LIQ1 | 61.25 | bead |
| LD10 | MAR4 | 35 | DA3 | 3.5 | LIQ1 | 61.5 | ball jarr |
| LD11 | MAR4 | 35 | DA2 | 3.1 | LIQ1 | 61.9 | ball jarr |
| LD12 | MAR4 | 35 | DA1 | 5.5 | LIQ1 | 60 | ball jarr |
| LD13 | MAR4 | 25 | DA2 | 0.9 | LIQ2 | 74.1 | ball jarr |

With the liquid developer dispersion LD1 to LD13 images were print with an optical density from 1.4 to 1.6 with an engine as described in EP12175762 at a speed of 60 m/min by diluting LD1 to LD13 to a solid content of 20%. The fusing step 170 was modified in such a way that the electrostatically transferred image from the intermediate roller 150 to the substrate is fed to a fusing station which contains a non contact infrared zone to accomplish to coalescence of the liquid developer dispersion and the adhesion to the substrate and after the infrared zone 3 heated rollers pairs are located to possible adjust the adhesion and gloss and to collect the separated carrier liquid for reuse to perform the dilution of the concentrated liquid developer to the desired printing concentration. On the heated rollers a scraper is mounted to collect the separated carrier liquid.

The infrared heater was equipped with ceramic tiles (Elstein type) to emit IR. The temperature of the tiles was adjusted to obtain a substrate temperature between 120 and 140° C. The heated rollers were operating between 110 and 130° C. The substrate was a 170 gsm coated paper from UPM The results are summarized in table 4

| name | ex/ com | hotplate separation | coalescense time (sec) | conductivity supernatans = conductivityA (pS/cm) | conductivity B < 5 * conductivityA + 5 | conductivity B < 2 * conductivityA + 5 | conductivity B <= conductivityA + 5 | adhesion | dispersion stabiltiy |
|---|---|---|---|---|---|---|---|---|---|
| LD1 | ex | OK | 17 | 0.05 | Y | Y | N | 1 | OK |
| LD2 | ex | OK | 10 | 8.6 | Y | Y | Y | 1 | OK |
| LD3 | ex | OK | 10 | 0.1 | Y | Y | N | 1 | OK |
| LD4 | ex | OK | 15 | 13 | Y | Y | Y | 1 | OK |
| LD5 | ex | OK | 15 | 30.7 | Y | Y | Y | 2 | OK |

-continued

| name | ex/ com | hotplate separation | coalescense time (sec) | conductivity supernatans = conductivityA (pS/cm) | conductivity B < 5 * conductivityA + 5 | conductivity B < 2 * conductivityA + 5 | conductivity B <= conductivityA + 5 | adhesion | dispersion stabiltiy |
|---|---|---|---|---|---|---|---|---|---|
| LD6 | ex | OK | 6 | 0.1 | Y | Y | n | 2 | OK |
| LD7 | ex | OK | 6 | 0.1 | Y | Y | N | 3 | OK |
| LD8 | ex | OK | 15 | 2.53 | Y | Y | N | 2 | OK |
| LD9 | com | slightly colored | 12 | 1.18 | N | N | N | 4 | OK |
| LD 10 | com | slightly colored | 22 | 1.3 | N | N | N | 4 | OK |
| LD 11 | com | NOK | no separation | 1.1 | N | N | N | 4 | OK |
| LD 12 | com | NOK | no separation | 45 | N | N | N | 4 | OK |
| LD 13 | ex | OK | 46 | 0.12 | Y | N | N | 2 | OK |

From the results it is clear that only the liquid developer dispersions (LD1 to LD9 and LD13) that fulfill the hotplate and conductivity criteria have a proper fusing.

From the results it is also clear that hotplate and conductivity criteria are more relevant to predict the fusing performance than the compounds used for preparing the liquid developer dispersion or the used manufacturing method.

LD1-LD6-LD7: different types of polyesters resins result in liquid developers with proper fusing.

LD1 to LD4: the type of manufacturing (bead versus ball jar milling) does not matter.

LD3 and LD12 show that depending on the concentration of the dispersing agent one can obtain a good or a bad separation of the marking and carrier liquid phase on the hotplate.

Clauses

1. Liquid developer dispersion for use in a digital printing apparatus comprising a non volatile carrier liquid, a marking particle, and a dispersing compound or a combination of dispersing compounds, wherein the marking particle in the liquid developer dispersion is stabilized during storage and during printing before fusing and wherein at fusing temperature a marking particle phase and a carrier liquid phase are formed.

2. Liquid developer dispersion according to clause 1, wherein the marking particle phase and the carrier liquid phase are formed in less than 60 seconds, when the liquid developer dispersion having a concentration of at least 20% marking particles, is put on a hotplate at 150° C.

3. Liquid developer dispersion according to clause 2, wherein the conductivity of the carrier liquid phase, formed after the developer dispersion is put on the hotplate, is less than 5 times conductivity A+5 pS/cm, preferably less than 3 times conductivity A+5 pS/cm, more preferably less than 2 times conductivity A+5 pS/cm, most preferred has the same conductivity as conductivity A+5 pS/cm, wherein conductivity A is the conductivity of the carrier liquid obtainable by centrifuging the developer dispersion and separating of the carrier liquid.

4. Liquid developer dispersion according to any one of the clauses 1 to 3, where at fusing temperature coalescence of the marking particles takes place at a speed which is sufficiently fast so that it can be used in a high speed digital printing equipment.

5. Liquid developer dispersion according to clause 4, wherein the high speed digital printing equipment prints at a speed of more than 50 cm/second.

6. Liquid developer dispersion according to any one of the clauses 1 to 5, wherein the carrier liquid has an electric conductivity at room temperature of at most 300 pS/cm, preferably at most 30 pS/cm and more preferably at most 3 pS/cm.

7. Liquid developer dispersion according to any one of the clauses 1 to 6, wherein the carrier liquid has a boiling point of at least 200° C.

8. Liquid developer dispersion according to any one of the clauses 1 to 7, wherein dielectric constant of the carrier liquid is less than 3.5.

9. Liquid developer dispersion according to any one of the clauses 1 to 8, wherein the carrier liquid is a mineral oil, a low viscosity or high viscosity liquid paraffin, isoparaffinc hydrocarbons, a fatty acid glyceride, a fatty acid ester or a vegetable oil or a combination thereof.

10. Liquid developer dispersion according to any one of the clauses 1 to 9, wherein the carrier liquid has a viscosity from 1 to 1000 mPas, preferably from 30 to 500 mPas, more preferably from 3 to 100 mPas, measured at 25° C. at shear rate of 1 Hz.

11. Liquid developer dispersion according to any one of the clauses 1 to 10, wherein the solid content in the developer dispersion is from 10 to 60 wt %, preferably from 15 to 45 wt %.

12. Liquid developer dispersion, according to any one of the clauses 1 to 11, wherein the dispersing compound has a HLB value between 1-5.

13. Process for printing using the liquid developer dispersion according to clause 1-12, wherein the process comprises the steps of fusing, whereby the liquid developer dispersion collapses and separates in a marking particle phase and a carrier liquid phase; and adhesion of marking particle phase to the substrate removing of the carrier liquid phase, whereby the removing occurs via a non evaporating step.

14. Printing apparatus comprising a fusing station comprising two parts, wherein at the first part fusing occurs and liquid developer dispersion according to clause 1-12 collapses and separates into a marking particle phase and a carrier liquid phase and adhesion and at the second part the carrier liquid phase is removed via a non evaporating step.

15. Process for preparing a liquid developer dispersion according to any one of the clauses 1 to 12, comprising mixing the marking particles with the dispersing compound and the carrier liquid and forming a predispersion of the liquid developer dispersion, and further milling the predispersion to provide the liquid developer dispersion according to clauses 1 to 13.

16. Digital printing process comprising the use of a liquid developer dispersion according to any one of the clauses 1 to 12, wherein during fusing the developer dispersion forms two different phases, a marking particle phase and a carrier liquid phase.

17. Digital printing process according to clause 16, wherein the marking particle phase and the carrier liquid phase are formed with a speed which is sufficiently high for use in a high speed digital printing equipment.

18. Use of liquid developer dispersion according to any one of the clauses 1 to 12, in an image forming apparatus, preferably a high speed digital printing apparatus, where the speed of printing is faster than 50 cm per second.

The invention claimed is:

1. A liquid developer dispersion for use in a digital printing apparatus comprising marking particles, a non volatile carrier liquid, and a dispersing compound or a combination of dispersing compounds, which carrier liquid has a boiling temperature such that it remains liquid at fusing temperature, such that the marking particles in the liquid developer dispersion are stabilized during storage and during printing before fusing and wherein at fusing temperature a marking particle phase and a carrier liquid phase are formed.

2. The liquid developer dispersion according to claim 1, wherein the marking particle phase and the carrier liquid phase are formed in less than 60 seconds, when the liquid developer dispersion having a concentration of at least 20% marking particles, is put on a hotplate at 150° C.

3. The liquid developer dispersion according to claim 2, wherein a conductivity of the carrier liquid phase, formed after the developer dispersion is put on the hotplate, is less than 5 times conductivity A+5 pS/cm, wherein conductivity A is the conductivity of the carrier liquid obtainable by centrifuging the developer dispersion and separating of the carrier liquid.

4. The liquid developer dispersion according to claim 1, wherein the carrier liquid has an electric conductivity at room temperature of at most 300 pS/cm.

5. The liquid developer dispersion according to claim 1, wherein the carrier liquid has a boiling point of at least 200° C.

6. The liquid developer dispersion according to claim 1, wherein dielectric constant of the carrier liquid is less than 3.5.

7. The liquid developer dispersion according to claim 1, wherein the carrier liquid is chosen from the group of a mineral oil, a low viscosity or high viscosity liquid paraffin, isoparaffinic hydrocarbons, a fatty acid glyceride, a fatty acid ester or a vegetable oil or a combination thereof.

8. The liquid developer dispersion according to claim 1, wherein the carrier liquid has a viscosity from 1 to 1000 mPas, preferably from 30 to 500 mPas, more preferably from 3 to 100 mPas, measured at 25° C. at shear rate of 1 Hz.

9. The liquid developer dispersion according to claim 1, wherein the solid content in the developer dispersion is from 10 to 60 wt %, preferably from 15 to 45 wt %.

10. The liquid developer dispersion according to claim 1, wherein the dispersing agent is a polymer with a backbone onto which polyhydroxystearate is grafted.

11. The liquid developer dispersion according to claim 10, wherein the dispersing agent has an acid number of 400-1000, preferably of 500-700 and more preferably 560-620.

12. A process for preparing the liquid developer dispersion according to claim 1, comprising a non volatile carrier liquid, marking particles, and a dispersing compound or a combination of dispersing compounds for stabilisation of the marking particles in the liquid developer dispersion during storage and during printing before fusing, which carrier liquid has a boiling temperature such that it remains liquid at fusing temperature, comprising:

mixing the marking particles with the dispersing compound and the carrier liquid and forming a predispersion of the liquid developer dispersion, and further milling the predispersion to provide the liquid developer dispersion.

13. The process as claimed in claim 12, wherein the marking particles are prepared by:

mixing pigment and binder resin, extruding the mixture at elevated temperature, and size reduction of the extrudate to a desired particle size to obtain the marking particles.

14. The process as claimed in claim 13, wherein the extrudate is reduced in size and mixed with the dispersing agent to form the predispersion by bringing the extrudate into a carrier liquid above the glass temperature Tg and a dispersing agent is added under mixing to form an emulsion, and wherein said emulsion is cooled down below the glass temperature Tg to transform into the predispersion.

15. The process as claimed in claim 13, wherein the particle size reduction of the marking particles in the predispersion is carried out by milling in a liquid milling device.

16. A process for printing using the liquid developer dispersion according to claim 1, comprising a non volatile carrier liquid, a marking particle, and a dispersing compound or a combination of dispersing compounds for stabilisation of the marking particle in the liquid developer dispersion during storage and during printing before fusing, wherein the process comprises the steps of fusing, whereby the liquid developer dispersion collapses and separates in a marking particle phase and a carrier liquid phase; and adhesion of marking particle phase to the substrate;

removing of the carrier liquid phase, wherein the removing occurs via a non evaporating step.

17. The process according to claim 16, wherein the carrier liquid phase is removed with a roller or by blowing off or by suction.

18. The process according to claim 16, wherein the temperature at fusing is such that coalescence of the marking particles takes place at a speed which is sufficiently fast so that it can be used in a high speed digital printing equipment.

19. The process according to claim 16, wherein the fusing is carried out without contact between the printed substrate and a heating member used for the fusing.

* * * * *